US006116606A

United States Patent [19]

Brum et al.

[11] Patent Number: 6,116,606

[45] Date of Patent: Sep. 12, 2000

[54] HIGH SPEED GLIDE TARGET

[75] Inventors: Roger D. Brum, Irvine; Bryan J. Martin, Mission Viejo, both of Calif.

[73] Assignee: Meggitt Defense Systems, Tustin, Calif.

[21] Appl. No.: 09/137,574

[22] Filed: Aug. 21, 1998

[51] Int. Cl.[7] ..... F41J 9/10

[52] U.S. Cl. ..... 273/360; 244/1 TD; 434/14

[58] Field of Search ..... 244/1 TD; 273/360, 273/361; 434/14, 15

[56] References Cited

U.S. PATENT DOCUMENTS

| | | | |
|---|---|---|---|
| Re. 34,873 | 3/1995 | Luttrell | 273/360 |
| 2,381,130 | 8/1945 | Lloyd . | |
| 2,448,343 | 8/1948 | Zandmer | 102/517 |
| 2,523,738 | 9/1950 | Trimbach | 273/361 |
| 2,551,596 | 5/1951 | Haglund | 324/226 |
| 2,813,719 | 11/1957 | Hopper | 273/361 |
| 2,898,588 | 8/1959 | Graham | 342/8 |
| 2,907,536 | 10/1959 | Von Zborowski | 244/12.1 |
| 2,923,549 | 2/1960 | Hopper et al. | 273/361 |
| 2,953,377 | 9/1960 | Brust | 273/361 |
| 2,998,754 | 9/1961 | Bialy | 89/1.816 |
| 3,002,708 | 10/1961 | Wetzel et al. | 244/3 |
| 3,065,967 | 11/1962 | Humphrey et al. | 273/360 |
| 3,135,511 | 6/1964 | Norman et al. | 273/360 |
| 3,225,655 | 12/1965 | Inglis | 89/1.816 |
| 3,410,559 | 11/1968 | Miller, Jr. et al. | 273/360 |
| 3,415,520 | 12/1968 | Woodward | 273/360 |
| 3,505,926 | 4/1970 | Johnson | 89/1.34 |
| 3,610,096 | 10/1971 | Bauman et al. | 89/1.808 |
| 3,735,985 | 5/1973 | Layer et al. | 273/362 |
| 3,808,941 | 5/1974 | Biggs | 89/1.51 |
| 4,000,867 | 1/1977 | Daikeler et al. | 244/1 TD |
| 4,205,848 | 6/1980 | Smith et al. | 273/361 |
| 4,366,962 | 1/1983 | Campbell et al. | 273/360 |
| 4,607,849 | 8/1986 | Smith et al. | 273/348.1 |
| 4,718,320 | 1/1988 | Brum | 89/1.11 |
| 4,770,368 | 9/1988 | Yates et al. | 244/1 TD |
| 4,852,455 | 8/1989 | Brum | 89/1.14 |
| 5,029,773 | 7/1991 | Lecat | 244/1 TD X |
| 5,078,406 | 1/1992 | Luttrell et al. | 273/360 |

FOREIGN PATENT DOCUMENTS

| | | | |
|---|---|---|---|
| 387881 | 9/1990 | European Pat. Off. | 273/360 |
| 13796 | 1/1990 | Japan | 273/360 |

OTHER PUBLICATIONS

Defense Electronics; Oct. 1986; vol. 18, No. 10.

*Primary Examiner*—John A. Ricci
*Attorney, Agent, or Firm*—Stetina Brunda Garred & Brucker

[57] ABSTRACT

A glide target comprising a fuselage having forward and aft ends. Movably attached to the fuselage is at least one control surface, while releasably attached to the fuselage is a tow line adaptor. Disposed within the fuselage is a tow line adaptor release mechanism which mechanically couples the tow line adaptor to the control surface in a manner wherein the (control surface is effectively locked into a set position until the tow line adaptor is detached from the fuselage. The glide target further comprises a glide target parachute which is disposed within the fuselage and a parachute launching mechanism which is also disposed within the fuselage and is used for selectively deploying the glide target parachute therefrom. The tow line adaptor, when attached to the fuselage, is cooperatively engaged to the parachute launching mechanism in a manner preventing the deployment of the glide target parachute from within the fuselage.

21 Claims, 4 Drawing Sheets

Fig. 3
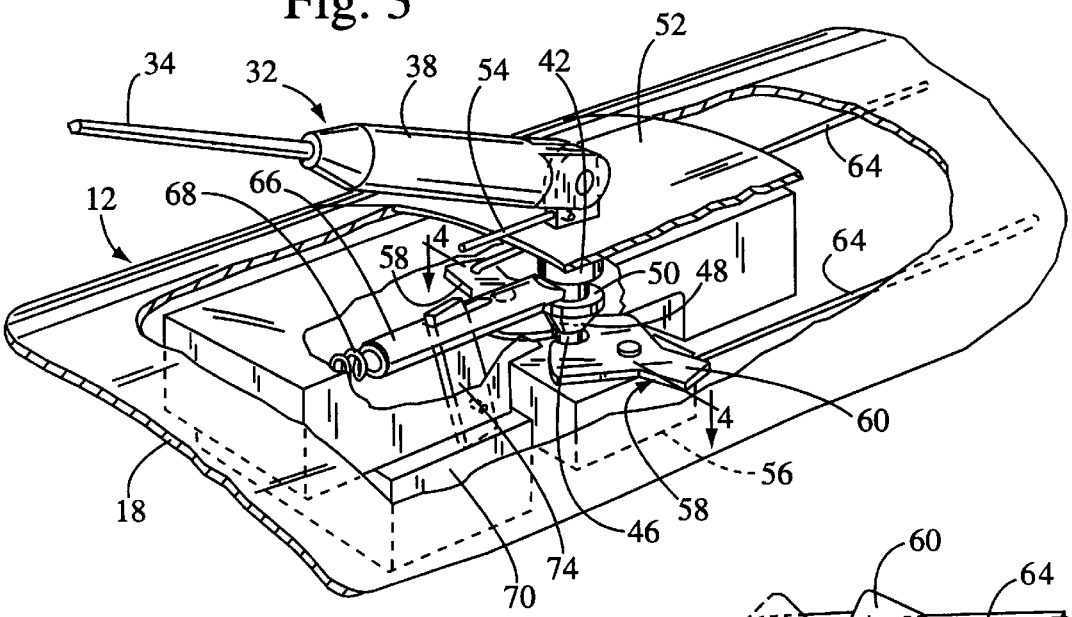
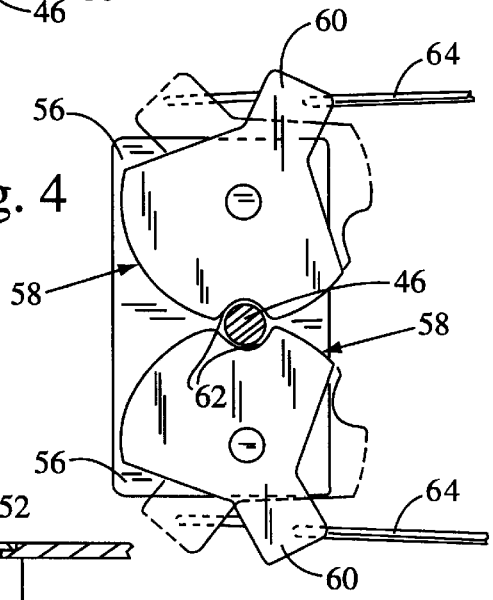
Fig. 4
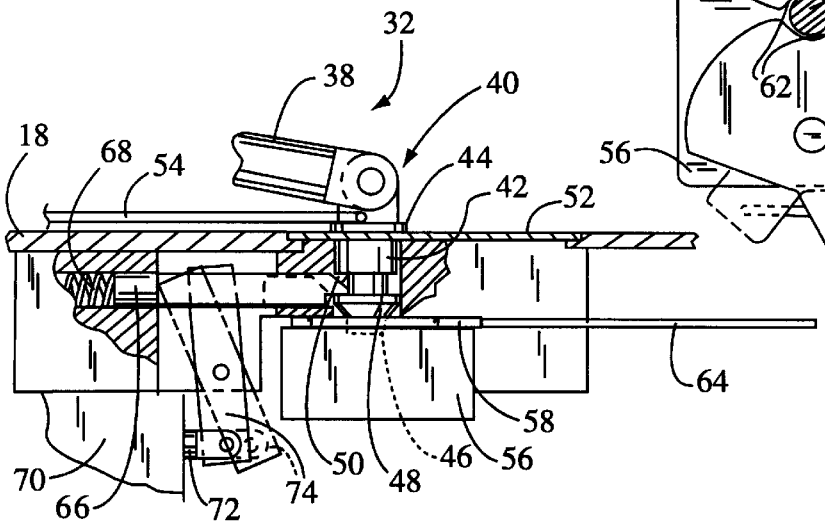
Fig. 5

Fig. 6
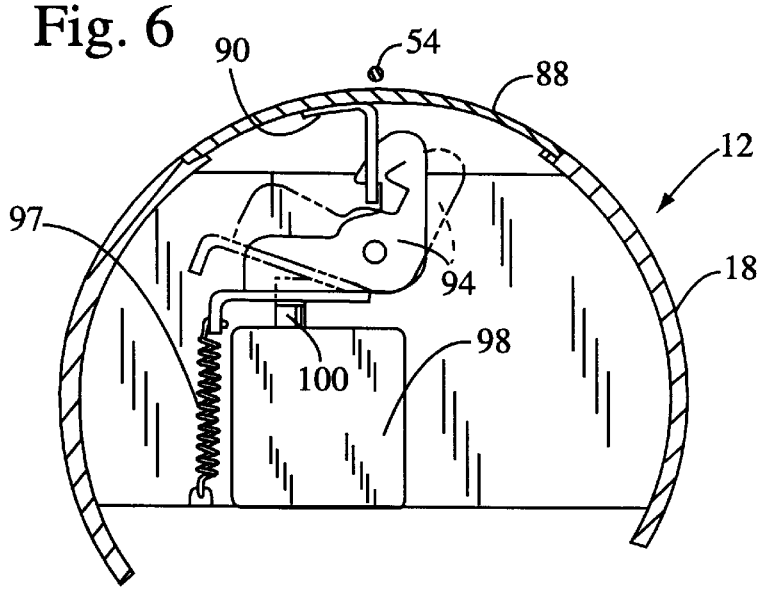
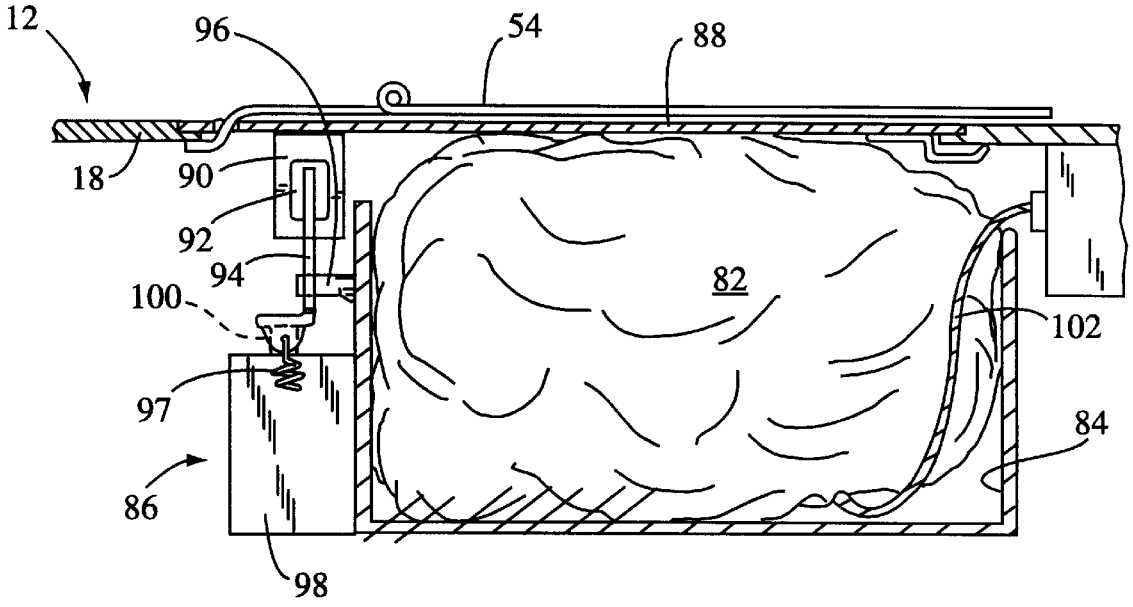
Fig. 7

Fig. 8
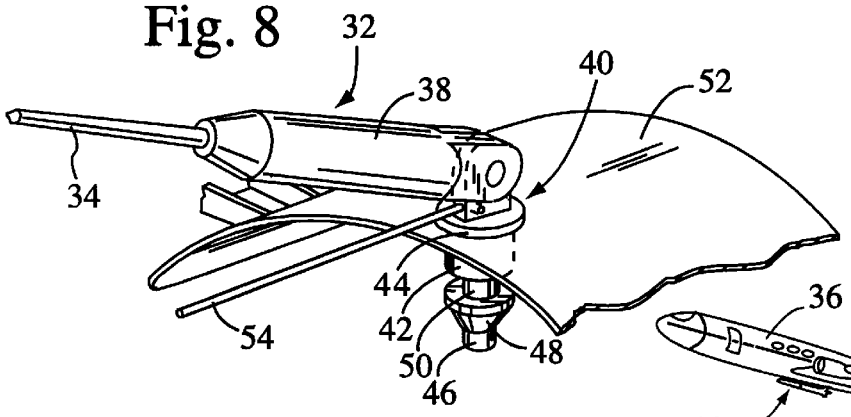
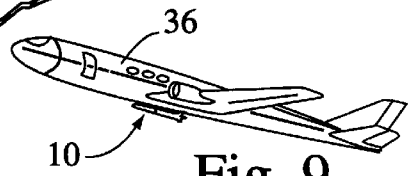
Fig. 9
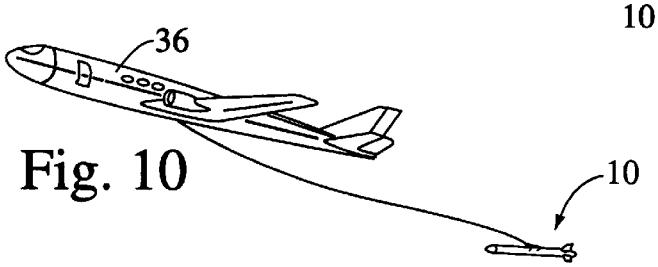
Fig. 10
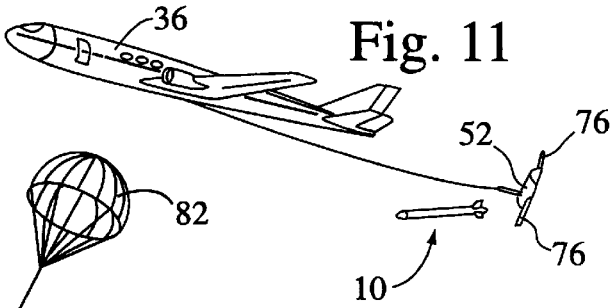
Fig. 11
Fig. 12
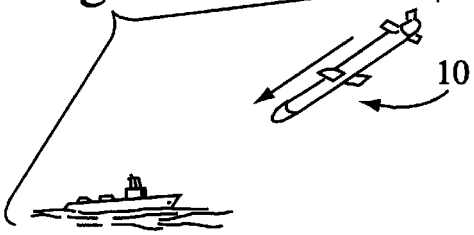
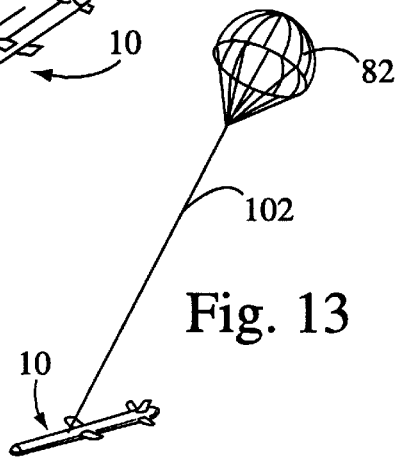
Fig. 13

HIGH SPEED GLIDE TARGET

FIELD OF THE INVENTION

The present invention relates generally to targets for medium to long range missiles, and more particularly to a cost effective high speed glide vehicle or target for air-to-air and surface-to-air weapon training which is simple to use and may be deployed quickly and easily from suitably equipped civilian or military aircraft.

BACKGROUND OF THE INVENTION

In the prior art, jet powered drones are frequently used as targets for medium to long range air-to-air and surface-to-air missiles. Though effective in their ability to serve as targets for missiles, these drones are extremely expensive to acquire, operate, and maintain. In this respect, the acquisition cost for a prior art jet powered drone is typically in the range of about $250,000 to $400,000, with the associated asset and launch costs being about $12,500 and $20,000, respectively, per mission. Based upon a typical loss rate of approximately 50% for jet powered drones, the aforementioned costs result in a total cost in the range of $137,500 to $210,000 per mission.

The high speed glide target constructed in accordance with the present invention provides a realistic long range target for surface-to-air and air-to-air weapon systems, and is capable of executing single or multiple simultaneous/stream attack profiles. Because of its cost-effective construction and minimal support equipment and personnel requirements, the per mission cost associated with the present glide target is a fraction of the per mission cost associated with a typical jet powered drone. A further advantage attendant to the use of the present glide target is that it can be deployed or launched quickly and easily from civilian or military, aircraft which are equipped with standard target towing equipment. These and other advantages attendant to the use of the present glide target will be discussed in more detail below.

SUMMARY OF THE INVENTION

In accordance with the present invention, there is provided a glide vehicle or target which comprises a fuselage having forward and aft ends. The fuselage itself comprises an elongate, generally cylindrical body having nose and tail cones attached to respective ones of the opposed ends thereof. The nose cone defines the forward end of the fuselage, with the tail cone defining its aft end. Attached to the body in relative close proximity to the tail cone are multiple tail fins, and in particular an upper pair of tail fins and a lower pair of tail fins. Also attached to the body at its approximate center of gravity is a fixed wing member which comprises a pair of wing segments extending outwardly from the body in generally opposed relation to each other.

In addition to the fuselage, the glide target of the present invention comprises a pair of control surfaces which are movably attached to respective ones of the lower pair of tail fins. Additionally, releasably attached to the fuselage, and in particular the body thereof, is a tow line adaptor of the glide target which is mechanically coupled to the control surfaces via a tow line adaptor release mechanism disposed within the body of the fuselage. In the present glide target, the tow line adaptor release mechanism mechanically couples the tow line adaptor to the control surfaces in a manner wherein the control surfaces are effectively locked into a set position until the tow line adaptor is detached from the body of the fuselage.

In the preferred embodiment, the tow line adaptor release mechanism comprises a pair of cam members which are attached to respective ones of a pair of control surface servomotors and are independently rotatable thereby. A pair of control rods of the tow line adaptor release mechanism are attached to and extend between the cam members and the control surfaces such that the rotation of each of the cam members facilitates the movement of a respective one of the control surfaces. The tow line adaptor, when attached to the body of the fuselage, is cooperatively engaged to the cam members in a manner preventing the rotation thereof by the control surface servomotors.

In addition to the control surface servomotors, cam members, and control rods, the tow mine adaptor release mechanism comprises a release pin which is mechanically coupled to a release pin servomotor and movable from a locked position to an unlocked position thereby. Cooperatively engaged to the release pin is a biasing spring which normally biases the release pin to its locked position. The release pin, when in its locked position, is cooperatively engaged to the tow line adaptor in a manner preventing the detachment thereof from the body of the fuselage. The movement of the release pin to its unlocked position is facilitated by the activation of the release pin servomotor which overcomes the biasing force exerted against the release pin by the biasing spring.

The glide target of the present invention further comprises a pair of wing lift spoilers which are attached to the tow line adaptor and extend longitudinally along the top surfaces of respective ones of the wing segments. In the present glide target, the detachment of the tow line adaptor from the fuselage body detaches the wing lift spoilers from the wing segments. In this respect, the tow line adaptor includes an arcuate cover plate which is releasably attached to the fuselage body. The curved contour of the cover plate matches that of the fuselage body such that the outer surfaces of the cover plate and fuselage body are substantially flush with each other when the tow line adaptor is attached to the fuselage body. The inboard ends of the wing lift spoiler are attached to the cover plate, with the detachment of the tow line adaptor from the fuselage body resulting in the removal of the wing lift spoilers from the wing segments of the fixed wing member and the restoration of lift thereto. The wing lift spoilers serve to significantly reduce the lift of the fixed wing member which is necessary to assure safe separation of the glide target from the deployment aircraft during reel out and stable tow performance of the glide target. The wing lift spoilers are maintained in attachment to the cover plate of tie tow line adaptor subsequent to its deployment from the fuselage body and serve to provide the drag necessary to stabilize the released end of the tow line.

The glide target of the present invention further comprises a glide target parachute and a parachute launching mechanism, both of which are disposed within the fuselage body. The parachute launching mechanism is used to selectively deploy the glide target parachute from within the fuselage body. In the preferred embodiment, the parachute launching mechanism comprises a parachute door which is releasably attached to he fuselage body. Cooperatively engaged to the parachute door is a latching member of the parachute launching mechanism which is movable between a latched position therein the parachute door is maintained in attachment to the fuselage body and an unlatched position wherein the parachute door may be detached from the fuselage body. Cooperatively engaged to the latching member is a parachute door servomotor which is operable to move the latching member between its latched and unlatched positions. The detachment of the parachute door from the fuselage body facilitates the deployment of the glide target parachute from therewithin.

In the present glide target, the tow line adaptor, when attached to the fuselage body, is cooperatively engaged to the parachute launching mechanism in a manner preventing the deployment of the glide target parachute from within the fuselage body. More particularly, the tow line adaptor includes a retaining rod which is cooperatively engaged to and maintains the parachute door in attachment to the fuselage body when the tow line adaptor is attached thereto. The detachment of the tow line adaptor from the fuselage body facilitates the release of the retaining rod from the parachute door which permits the detachment thereof from the fuselage body upon the movement of the latching member to its unlatched position by the parachute door servomotor.

Further in accordance with the present invention, there is provided a method of deploying a glide target from an aircraft which is outfitted with a reeling machine including a tow line. The preferred method comprises the initial step of attaching the glide target to the free end of the tow line. Thereafter, the aircraft is caused to climb to a first altitude of approximately ten thousand (10,000) feet and maintain a first air speed of approximately 200 knots. The glide target is then deployed from the aircraft by the reeling out the tow line of the reeling machine, with the glide target preferably being reeled out to a distance of approximately fifty (50) meters from the aircraft. Subsequent to the glide target being deployed therefrom, the aircraft is caused to climb to a second altitude of approximately forty thousand (40,000) feet and is accelerated to a second air speed of approximately 350 knots. Thereafter, the glide target is released from the tow line. Subsequent to its release from the tow line, global positioning satellites are used to cause the glide target to glide on a pre-programmed course toward an assigned destination under active monitoring and, if desired, control from a launch control site.

BRIEF DESCRIPTION OF THE DRAWINGS

These, as well as other features of the present invention, will become more apparent upon reference to the drawings wherein:

FIG. 3 is a perspective view of the tow line adaptor, tow line adaptor release mechanism, and wing lift spoilers of the present glide target;

FIG. 4 is a cross-sectional view taken along line 4—4 of FIG. 3;

FIG. 5 is a side-elevational view of the tow line adaptor and tow line adaptor release mechanism shown in FIG. 3;

FIG. 6 is a cross-sectional view taken along line 6—6 of FIG. 2;

FIG. 7 is a side-elevational view of the glide target parachute and parachute launching mechanism of the present glide target;

FIG. 8 is a perspective view of the tow line adaptor of the present glide target, illustrating the tow line adaptor cover plate and glide target parachute door retaining rod thereof; and FIGS. 9–13 illustrate a preferred step-by-step sequence for the use of the present glide target.

DETAILED DESCRIPTION OF THE PREFERRED EMBODIMENT

Figure 1:
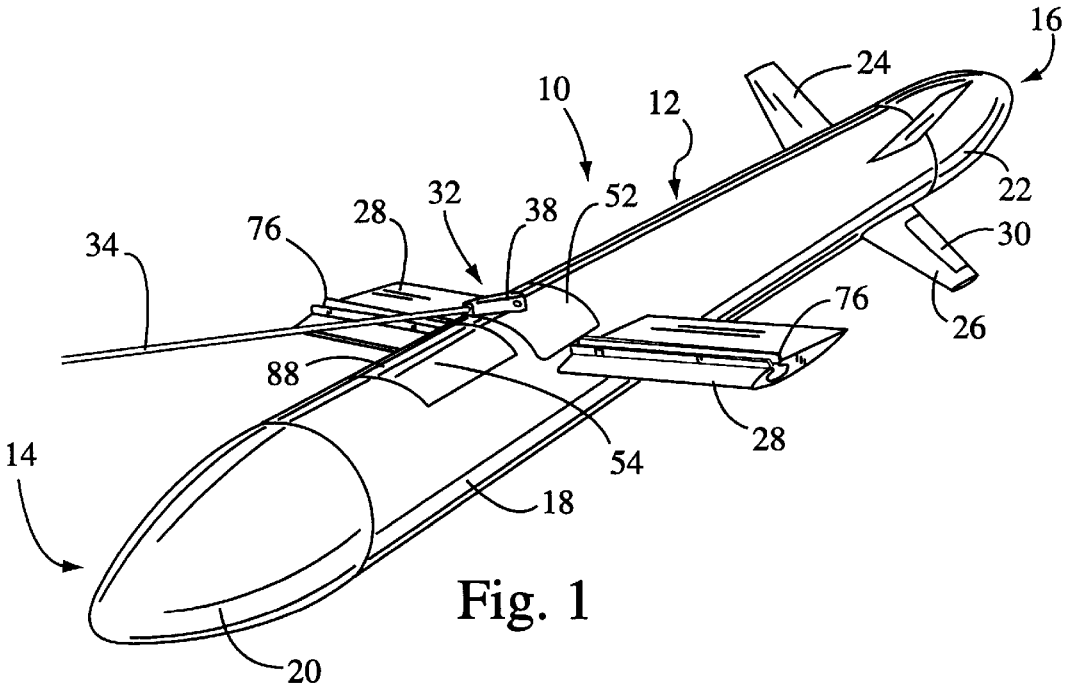
FIG. 1 is a front perspective view of the glide target constructed in accordance with the present invention.
Figure 2:
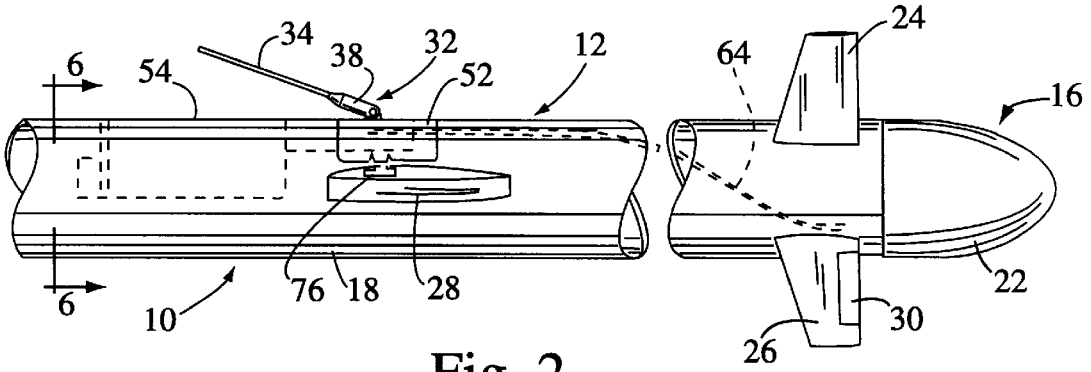
FIG. 2 is a side-elevational view of the central and aft portions of the present glide target.

Referring now to the drawings wherein the showings are for purposes of illustrating a preferred embodiment of the present invention only, and not for purposes of limiting the same, FIG. 1 perspectively illustrates a high speed glide vehicle or target 10 constructed in accordance with the present invention. The glide target 10 is adapted for use in relation to air-to-air and surface-to-air weapons training, and provides a sophisticated yet simple to use missile target that can be deployed quickly and easily from suitably equipped civilian or military aircraft. Costing less than the price of launching a high performance jet powered drone, the glide target 10 offers a challenging and realistic target for surface-to-air weapons systems, while also being suitable for use with both radar and infrared guided missiles in the air-to-air scenario.

In the preferred embodiment, the glide target 10 comprises a fuselage 12 having a forward end 14 and an aft end 16. The fuselage 12 itself comprises an elongate, tubular body 18 which has a generally cylindrical configuration and a preferred diameter of approximately 7.5 inches. Attached to one end of the body 18 is a nose cone 20 which defines the forward end 14 of the fuselage 12. Additionally, attached to the opposite end of the body 18 is a tail cone 22 which defines the aft end 16 of the fuselage 12. The fuselage 12 further includes an upper pair of tail fins 24 and a lower pair of tail fins 26 which are each attached to the body 18 in relative close proximity to the tail cone 22. Also attached to the body 18 at approximately the center of gravity thereof is a pair of fixed wing segments 28 which extend outwardly from the body 18 in generally opposed relation to each other. The nose and tail cones 20, 22 of the fuselage 12 are preferably hollow, and are capable of housing radar and/or infrared augmenters of the glide target 10. The nose and tail cones 20, 22 may also be used to accommodate payloads other than for radar or infrared augmenters.

The glide target 10 of the present invention further includes a pair of control surfaces 30 which are movably attached to respective ones of the lower pair of tail fins 26 of the fuselage 12. As will be discussed in more detail below, the control surfaces 30 of the lower pair of tail fins 26 are servo driven and operate as "elevons" in an inverted V-tail configuration.

Referring now to FIGS. 1–5 and 8, the glide target 10 of the present invention further comprises a tow line adaptor 32 which is releasably attached to the body 18 of the fuselage 12 and is used to facilitate the connection of the glide target 10 to a tow line 34. As will be discussed in more detail below, the tow line 34 is wound upon a reeling machine which is provided on a launch aircraft 36. The tow line adaptor 32 comprises an elongate adaptor member 38, one end of which is attached to the free end of the tow line 34. In addition to the adaptor member 38, the tow line adaptor 32 includes a pin member 40, the top end of which is pivotally connected to that end of the adaptor member 38 opposite the end attached to the tow line 34. As seen in FIGS. 3 and 4, the pin member 40 of the tow line adaptor 32 includes a generally cylindrical central portion 42. The central portion 42 is separated from the top end of the pin member 40 which is pivotally connected to the adaptor member 38 by a flange 44 extending radially outward therefrom. The pin member 40 further includes a cylindrically configured bottom end 46 which transitions into a beveled shoulder 48. Formed within and extending about the central portion 42 in relative close proximity to the beveled shoulder 48 is a continuous channel 50.

In addition to the adaptor member 38 and pin member 40, the tow line adaptor 32 of the glide target 10 includes an arcuately contoured cover plate 52 which is attached to the central portion 42 of the pin member 40. The curvature of the cover plate 52 matches that of the body 18 such that when the tow line adaptor 32 is attached to the body 18, the outer surfaces of the cover plate 52 and the body 18 are substantially flush with each other. The attachment of the cover plate 52 to the pin member 40 is facilitated by the advancement of the central portion 42 into a circularly configured opening disposed within the cover plate 52 adjacent one of the lateral sides thereof. The advancement of the central portion 42 into the opening is limited by the abutment of the cover plate 52 against the underside of the flange 44 which extends radially outward from the central portion 42. Also attached to the pin member 40 between the top end thereof which is pivotally connected to the adaptor member 38 and the flange 44 is one end of an elongate retaining rod 54 of the tow Line adaptor 32. The uses of the cover plate 52 and retaining rod 54 will be described in more detail below.

Referring now to FIGS. 2–5, the glide target 10 of the present invention further comprises a tow line adaptor release mechanism which is disposed within the body 18 of the fuselage 12 and is used to mechanically couple the tow line adaptor 32 to the control surfaces 30 in a manner wherein the control surfaces 30 are effectively locked into a set position until the tow line adaptor 32 is detached from the body 18. The tow line adaptor release mechanism comprises a pair of control surface servomotors 56 and a pair of cam members 58 which are attached to respective ones of the control surface servomotors 56 and independently rotatable thereby. As best seen in FIG. 4, the cam members 58 are mirror images of each other, and each include an outer ear portion 60 and an inner arcuate surface which includes a generally semi-circular notch 62 formed therein. In addition to the control surface servomotors 56 and cam members 58, the tow line adaptor release mechanism includes a pair of elongate control rods 64 which are attached to and extend between the cam members 58 and the control surfaces 30. In this respect, one end of each control rod 64 is attached to the ear portion 60 of a respective one of the cam members 58, with the opposite end of the control rod 64 being attached to a respective one of the control surfaces 30. As such, due to the extension of the control rods 64 therebetween, the rotation of each of the cam members 58 by a respective one of the control surface servomotors 56 facilitates the movement of a respective one of the control surfaces 30.

In order for the tow line adaptor 32 to be properly attached to the body 18, the bottom end 46 of the pin member 40 must be advanced between the cam members 58 of the tow line adaptor release mechanism. For such advancement to occur, the cam members 58 must be rotated into positions relative to each other wherein the notches 62 thereof are aligned in a manner collectively defining a generally circular opening which accommodates the bottom end 46 of the pin member 40. When the cam members 58 are rotated such that the notches 62 thereof define this opening the control surfaces 30 are moved by the control rods 64 into prescribed set positions. As will be discussed in more detail below, these prescribed set positions of the control surfaces 30 are adapted to prevent the glide target 10 from gliding upwardly toward the aircraft 36 during the deployment operation. Importantly, prior to the detachment of the tow line adaptor 32 from the body 18, the extension of the bottom end 46 of the pin member 40 into the opening collectively defined by the notches 62 effectively prevents any rotation of the cam members 58 relative to each other. In this respect, any such rotation is resisted by the interference of the cam member(s) 58 against the bottom end 46 of the pin member 40. Thus, until the tow line adaptor 32 is detached from the body 18, any accidental rotation of the cam members 58 as would move the control surfaces 30 from their prescribed set positions is prevented.

The tow line adaptor release mechanism of the glide target 10 further comprises an elongate release pin 66 which is slidably moveable within the body 18 between a locked position and an unlocked position. As best seen in FIGS. 3 and 5, the release pin 66 defines a beveled end, and is oriented within the body 18 such that the beveled end thereof is aligned with the channel 50 of the pin member 40 when the bottom end 46 thereof is received into the opening collectively defined by the notches 62 of the cam members 58. When the release pin 66 is in its locked position, the beveled end thereof is extended into the channel 50, thus effectively preventing the upward movement of the pin member 40 relative to the body 18, and hence the detachment of the tow line adaptor 32 therefrom. The movement of the release pin 66 to its unlocked position causes the beveled end thereof to be retracted from within the channel 50 of the pin member 40 which permits the detachment of the tow line adaptor 32 from the body 18.

The release pin 66 is normally biased to its locked position by a biasing spring 68 of the tow line adaptor release mechanism which extends between a bulkhead within the interior of the body 18 and that end of the release pin 66 opposite its beveled end. The movement of the release pin 66 to its unlocked position is facilitated by the activation of a release pin servomotor 70 which is mechanically coupled thereto. In this respect, the release pin servomotor 70 includes a piston 72 extending therefrom which is reciprocally movable inwardly and outwardly relative thereto. The distal end of the piston 72 is pivotally connected to one end of a link member 74, the opposite end of which is pivotally connected to the release pin 66. The link member 74 is further pivotally connected at its approximate center to a bulkhead within the interior of the body 18. The outward movement of the piston 72 of the release pin servomotor 70 rotates the link member 74 in a manner facilitating the movement of the release pin 66 away from the pin member 40 and hence the retraction of the beveled end of the release pin 60 from within the channel 50. As will be recognized, the force exerted by the release pin servomotor 70 against the link member 74 and hence the release pin 66 is sufficient to overcome the biasing force exerted by the biasing spring 68 against the release pin 66.

As seen in FIGS. 1 and 3, the glide target 10 also includes a pair of elongate wing lift spoilers 76 which are attached to the cover plate 52 of the tow line adaptor 32. More particularly, the inboard end of each wing lift spoiler 76 is attached to the approximate center of a respective one of the lateral edges of the cover plate 52 such that the wing lift spoiler 76 extends outwardly therefrom. In the glide target 10, when the tow line adaptor 32 is properly attached to the body 18 (i.e., the release pin 66 is engaged to the pin member 40 with the bottom end 46 thereof being inserted between the cam members 58), the cover plate 52 of the tow line adaptor 32 is releasably attached to the body 18, with the wing lift spoiler 76 extending longitudinally along respective ones of the fixed wing segments 28.

As will also be discussed in more detail below, due to the attachment of the cover plate 52 to the pin member 40, the detachment of the tow line adaptor 32 from the 18 facilitates the removal of the cover plate 52 therefrom. Additionally, due to the attachment of the wing lift spoilers 76 to the cover plate 52, the movement of the tow line adaptor 32 away from the body 18 subsequent to its detachment therefrom, in addition to resulting in the removal of the cover plate 52 from the body 18, also results in the removal of the wing lift spoilers 76 from the fixed wing segments 28. As will be recognized, the wing lift spoilers 76 are maintained in attachment to the tow line adaptor 32, and in particular its cover plate 52, subsequent to the detachment of the tow line adaptor 32 from the body 18.

Referring now to FIGS. 6 and 7, the glide target 10 of the present invention further comprises a glide target parachute 82 which is normally stored within a parachute well 84 defined within the interior off the body 18 between the tow line adaptor release mechanism and the nose cone 20. The selective deployment of the glide target parachute 82 from the glide target 10 (i.e., from within the second parachute well 84) is controlled by a parachute launching mechanism 86 of the glide target 10. The parachute launching mechanism 86 comprises a parachute door 88 which is releasably attached to the body 13 of the fuselage 12. When attached to the body 18, the parachute door 88 effectively encloses the glide target parachute 82 within the interior of the body 18, and in particular the parachute well 84 defined therewithin. The parachute door 88 includes a coupling member 90 which is attached to and extends downwardly from the inner surface thereof and defines a central opening 92.

In addition to the parachute door 88, the parachute launching mechanism 86 includes a latching member 94 which is pivotally connected to the second parachute well 84 by a pivot pin 96. Attached to the latching member 94 is one end of a biasing spring 97, the opposite end of which is attached to a support structure within the interior of the body 18. As seen in FIG. 6, the latching member 94 is movable between a latched position wherein a hook portion thereof is extended into the central opening 92 of the coupling member 90, and an unlatched position wherein the hook portion of the latching member 94 is rotated away from the coupling member 90. The latching member 94 is normally biased to its latched position by the biasing spring 97. When the latching member 94 is in its latched position, the cooperative engagement thereof to the coupling member 90 of the parachute door 88 prevents the, detachment of the parachute door 88 from the body 113. Conversely, the movement of the latching member 94 to its unlatched position permits the parachute door 88 to be detached from the body 18.

The movement of the latching member 94 between its latched and unlatched positions is facilitated by a parachute door servomotor 98 of the parachute launching mechanism 86 which is cooperatively engaged to the latching member 94. The parachute servomotor 98 includes a piston 100 extending upwardly therefrom which is reciprocally moveable upwardly and downwardly relative thereto. The distal end of the piston 98 is normally abutted against the latching member 94, with the upward movement of the piston 100 resulting in the rotation of the hook portion of the latching member 94 away from the coupling member 90 of the parachute door 88. Conversely, due to the biasing force exerted against the latching member 94 by the biasing spring 97, the downward movement of the piston 100 results in the rotation of the latching member 94 in a manner wherein the hook portion thereof is inserted into the central opening 92 of the coupling member 90. When the parachute door 88 is removed from the body 18 and the glide target parachute 82 pulled from within the parachute well 84 and deployed from the glide target 10, the glide target parachute 82 is maintained in attachment to the glide target 10 by an elongate static line 102 extending between the glide target parachute 82 and the parachute well 84.

Any accidental deployment of the glide target parachute 82 from the body 18 while the glide target 10 is being towed by the aircraft 36 is extremely undesirable due to the resultant yaw which could be exerted upon the aircraft 36. To prevent any premature deployment of the glide target parachute 82, the parachute door 88 of the parachute launching mechanism 86 is prevented from being removed from the body 18 prior to the detachment of the tow line adaptor 32 therefrom. In this respect, as seen in FIGS. 1 and 7, when the tow line adaptor 32 is properly attached to the body 18, the retaining rod 54 thereof extends longitudinally along the approximate center of the outer surface of the parachute door 88. The end of the retaining rod 54 opposite that attached to the pin member 40 of the tow line adaptor 32 is cooperatively engaged to the body 18. As will be recognized, the retaining rod 54, when extended over the parachute door 88 and cooperatively engaged to the body 18, prevents the detachment of the parachute door 88 from the body 18. The detachment of the tow line adaptor 32 from the body 18 releases the distal end of the retaining rod therefrom, thus resulting in the complete removal of the retaining rod 54 from the body 18. Importantly, such removal allows the parachute door 88 to itself be detached from the body 18 upon the movement of the latching member 94 to its unlatched position by the parachute door servomotor 98.

Having thus described the components of the glide target 10, the preferred manner of using the same will now be discussed with reference to FIGS. 9–13.

The glide target 10 is used by releasably attaching the same to the launch aircraft 36. In addition to being releasably attached to the aircraft 36, the glide target 10 is also releasably attached to the free end of the tow line 34 extending from the reeling machine with which the aircraft 36 is outfitted. The releasable attachment of the glide target 10 to the tow line 34 is facilitated by the tow line adaptor 32 of the glide target 10. As described above, when the tow line adaptor 32 is attached to the body 18, the bottom end 46 of the pin member 40 is received into the opening collectively defined by the notches 62 of the cam members 58, with the release pin 60 being cooperatively engaged to the pin member 40. Due to the extension of the bottom end 46 of the pin member 40 between the cam members 58, the control surfaces 30 of the glide target 10 are maintained in prescribed set positions.

As seen in FIG. 9, subsequent to the attachment of the glide target 10 to the underside thereof, the aircraft 36 is caused to take off and climb to an altitude of approximately 10,000 feet. In addition to maintaining this particular altitude, the aircraft 36 also preferably maintains an air speed of approximately 200 knots. As seen in FIG. 10, at this altitude and air speed, the glide target 10 is disconnected from the aircraft 36, with the reeling machine then being caused to reel out the tow line 34 to deploy the glide target 10 from the aircraft 36. The glide target 10 is preferably reeled out a distance of approximately 50 meters from the aircraft 36. Importantly, as the glide target 10 is being reeled out from the aircraft 36, the prescribed set positions of the control surfaces 30 thereof maintain a neutral pitch on the nose cone 20 of the glide target 10 with the wing lift spoilers 76 effectively reducing the lift of the fixed wing segments 28, thus preventing the glide target 10 from gliding upwardly toward the aircraft 36. As previously indicated, the continued attachment of the tow line adaptor 32 to the body 18 as the glide target 10 is being towed behind the aircraft 36 prevents any rotation of the cam members 58 as would result in the movement of the control surfaces 30 from their set positions, and also maintains the wing lift spoilers 76 in position upon the fixed wing segments 28.

After the glide target 10 has been fully reeled out by the reeling machine, the aircraft 36 is caused to climb to an altitude of approximately 40,000 feet and is accelerated to an air speed of approximately 350 knots. As will be recognized, as the aircraft 36 climbs to this altitude and accelerates to this air speed, the glide target 10 continues to be towed behind the aircraft 36 by the tow line 34.

As seen in FIG. 11, once the aircraft 36 reaches the preferred altitude of 40,000 feet and is accelerated to the *preferred air speed of 350 knots, a control signal is transmitted to the glide target 10 from a launch control site which facilitates the activation of the release pin servomotor 70 in a manner causing the release pin 66 to move from its normal locked position to its unlocked position. Due to the set positions of the control surfaces 30 maintaining a neutral pitch angle for the glide target 10, the movement of the release pin 66 to its unlocked position results in the pin member 40 being pulled from within the body 18. As described above, the release of the pin member 40 from within the body 18 results in the removal of both the cover plate 52 and retaining rod 54 from the body 18. As also described above, the removal of the cover plate 52 from the body 18 further results in the removal of the wing lift spoilers 76 from the fixed wing segments 28, with the wing lift spoilers 76 being maintained in attachment to the tow line adaptor 32, and in particular the cover plate 52 thereof. Importantly, the drag exerted upon the tow line 34 by the cover plate 52 and wing lift spoilers 76 of the tow line adaptor 32 prevents the tow line 34 from interfering with the glide target 10 immediately upon the release of the pin member 40 from within the body 18. The drag also serves to stabilize the released end of the tow line 34 to prevent it from whipping.

Referring now to FIG. 12, upon the detachment of the glide target 10 from the tow line 34, the flight path thereof may be controlled by the selective movement of the control surfaces 30 by the control surface servomotors 56 which are attached thereto via the cam members 58 and control rods 64. As will be recognized, once the pin member 40 is released from within the body 18, the removal of the bottom end 46 from within the opening collectively defined by the notches 62 of the cam members 58 allows the cam members 58 to be individually or simultaneously rotated by the control surface servomotors 56, thus achieving the desired movement of the control surfaces 30. During the flight of the glide target 10, the flight path thereof may be selectively altered by actuating the control surface servomotors 56 through signals transmitted thereto from the launch control site or pre-programmed into the onboard control computer.

Referring now to FIG. 13, in the event the glide target 10 is not destroyed by a surface-to-air or air-to-air missile, it may be salvaged by the deployment of the glide target parachute 82 from the body 18. In this respect, a control signal may be transmitted from the launch control site to the parachute door servomotor 90 which facilitates the activation thereof in a manner causing the movement of the latching member 94 from its normal latched position to its unlatched position. Due to the removal of the retaining rod 54 from the body 18 upon the detachment of the tow line adaptor 32 therefrom, the movement of the latching member 94 to its unlatched position causes the parachute door 88 to be immediately ejected from the body 18. Subsequent to such ejection or removal, the glide target parachute 82 is immediately deployed from within the parachute well 84, and is maintained in attachment to the body 18 via the static line 102 extending between the glide target parachute 82 and the second parachute well 84.

The glide target 10 of the present invention is provided with programmable avionics hardware which facilitates the communications link between the launch control site and the control surfaces, release pin, and parachute door servomotors 56, 70, 98. Typically, the aircraft 36 will tow the glide target 10 to a location outside the range of a particular weapon prior to releasing the glide target 10. The glide target 10 then preferably flies a pre-planned profile with active control inputs from the launch control site. During the mission, a two-way data link is maintained between the glide target 10 and the launch control site. If a dangerous condition is noted, the deployment of the glide target parachute 82 effectively terminates the mission in that such deployment stops the forward travel of the glide target 10 within a few hundred feet.

The capability of the avionics hardware provided with the glide target 10 allows for the performance of highly complex missions thereby. The operator at the launch control site may manipulate the glide target 10 by commanding turns and/or controlling the decent rate thereof. Feedback to the operator at the launch control site will typically be provided in the form of a global positioning satellite track on a computer screen map. In this respect, the glide target 10 is also provided with a GPS unit, with the launch aircraft 36 itself preferably being provided with a second GPS unit to provide simultaneous tracking thereof for purposes of insuring safety.

The present glide target 10 may execute single or multiple simultaneous/stream attack profiles. As indicated above, the air speed and navigation of the glide target 10 are controlled by its on-board navigation package including the avionics hardware and GPS unit, with such navigation package typically being programmed prior to launch and capable of being updated during the mission if required. In this respect, the navigation packages of the glide target 10 provides guidance and control thereto which enables preplanned missions with or without real time active control to be conducted over the full glide range of the glide target 10. The glide target 10 is capable of being launched from either military or commercial aircraft at a standoff range of up to 45 nautical miles. Additionally, the glide target may be augmented to meet the needs of current weapons systems, with payload/enhancements including passive or active radar and infrared jet plume generators. As also indicated above, the GPS information is transmitted from the glide target 10 to the launch control site to provide real time tracking. The launch control site/tracking station itself may be airborne or ground based, though the preferred launch control site is within the aircraft 36.

The glide target 10 of the present invention is preferably operated over an air speed range from 200 to 400 KCAS. In this respect, the glide target 10 is adapted to achieve its maximum ultimate range at 200 KCAS, which has the result of also maximizing flight duration. When the glide target 10 is flown at a constant 200 KCAS after being deployed at an altitude of 40,000 feet, the ultimate range is over 45 nautical miles.

Additional modifications and improvements of the present invention may also be apparent to those of ordinary skill in the art. Thus, the particular combination of parts described and illustrated herein is intended to represent only one embodiment of the present invention, and is not intended to serve as limitations of alternative devices within the spirit and scope of the invention.

What is claimed is:

1. A glide target comprising:

a fuselage having forward and aft ends;

at least one control surface movably attached to the fuselage;

a tow line adaptor releasably attached to the fuselage; and a tow line adaptor release mechanism disposed within the fuselage and mechanically coupling the tow line adaptor to the control surface in a manner wherein the control surface is effectively locked into a set position until the tow line adaptor is detached from the fuselage.

2. The glide target of claim 1 wherein said at least one control surface comprises a pair of control surfaces movably attached to the fuselage.

3. The glide target of claim 2 wherein the fuselage comprises:

an elongate, generally cylindrical body;

a nose cone attached to the body and defining the forward end of the fuselage;

a tail cone attached to the body and defining the aft end of the fuselage; and multiple tail fins attached to said body;

said control surfaces being movably attached to respective ones of said tail fins.

4. The glide target of claim 3 wherein said fuselage includes an upper pair of tail fins and a lower pair of tail fins, said control surfaces being movably attached to respective ones of the lower pair of tail fins.

5. The glide target of claim 3 wherein the fuselage further comprises a fixed wing member attached to the body.

6. The glide target of claim 2 wherein the tow line adaptor release mechanism comprises:

a pair of control surface servomotors;

a pair of cam members attached respective ones of said control surface servomotors and independently rotatable thereby; and a pair of control rods attached to and extending between the cam members and the control surfaces such that the rotation of each of the cam members facilitates the movement of a respective one of the control surfaces;

said tow line adaptor, when attached to the fuselage, being cooperatively engaged to the cam members in a manner preventing the rotation thereof by the control surface servomotors.

7. The glide target of claim 6 wherein the tow line adaptor release mechanism further comprises:

a release pin movable between a locked position and an unlocked position; and a release pin servomotor mechanically coupled to the release pin and operable to move the release pin from the locked position to the unlocked position;

said release pin, when in the locked position, being cooperatively engaged to the tow line adaptor in a manner preventing the detachment thereof from the fuselage.

8. The glide target of claim 7 wherein the tow line adaptor release mechanism further comprises a biasing spring which is cooperatively engaged to the release pin and normally biases the release pin to the locked position.

9. The glide target of claim 1 further comprising:

at least one wing lift spoiler attached to the tow line adaptor such that the detachment of the tow line adaptor from the fuselage facilitates the removal of the wing lift spoiler therefrom;

said wing lift spoiler being maintained in attachment to the tow line adaptor subsequent to the deployment thereof from the fuselage.

10. The glide target of claim 9 wherein the tow line adaptor comprises:

a cover plate releasably attached to the fuselage, said at least one wing lift spoiler comprising a pair of wing lift spoilers which are attached to the cover plate;

the detachment of the tow line adaptor from the fuselage facilitating the removal of the cover plate and the wing lift spoilers therefrom.

11. The glide target of claim 10 wherein said fuselage comprises a pair of fixed wing segments and said fixed wing spoilers are removably positioned upon respective ones of the fixed wing segments.

12. The glide target of claim 1 further comprising:

a glide target parachute disposed within the fuselage; and a parachute launching mechanism disposed within the fuselage for selectively deploying the glide target parachute from therewithin;

said tow line adaptor, when attached to the fuselage, being cooperatively engaged to the parachute launching mechanism in a manner preventing the deployment of the glide target parachute from within the fuselage.

13. The glide target of claim 12 wherein said parachute launching mechanism comprises:

a parachute door releasably attached to the fuselage;

a latching member cooperatively engaged to the parachute door and movable between a latched position wherein the parachute door is maintained in attachment to the fuselage and an unlatched position wherein the parachute door may be detached from the fuselage; and a parachute door servomotor cooperatively engaged to the latching member and operable to move the latching member between the latched and unlatched positions;

the detachment of the parachute door from the fuselage facilitating the deployment of the glide target parachute from therewithin.

14. The glide target of claim 13 wherein:

the tow line adaptor comprises a retaining rod which is cooperatively engaged to and maintains the parachute door in attachment to the fuselage when the tow line adaptor is attached thereto;

the detachment of the tow line adaptor from the fuselage facilitating the release of the retaining rod from the parachute door which permits the detachment thereof from the fuselage upon the movement of the latching member to the unlatched position.

15. A glide target comprising:

a fuselage having forward and aft ends;

at least one control surface movably attached to the fuselage;

a tow line adaptor releasably attached to the fuselage;

a glide target parachute disposed within the fuselage; and a parachute launching mechanism disposed within the fuselage for selectively deploying the glide target parachute therefrom;

said tow line adaptor, when attached to the fuselage, being cooperatively engaged to the parachute launching mechanism in a manner preventing the deployment of the glide target parachute from within the fuselage.

16. The glide target of claim 15 wherein said parachute launching mechanism comprises:

a parachute door releasably attached to the fuselage;

a latching member cooperatively engaged to the parachute door and movable between a latched position wherein the parachute door is maintained in attachment to the fuselage and an unlatched position wherein the parachute door may be detached from the fuselage; and a parachute door servomotor cooperatively engaged to the latching member and operable to move the latching member between the latched and unlatched positions;

the detachment of the parachute door from the fuselage facilitating the deployment of the glide target parachute from therewithin.

17. The glide target of claim 16 wherein:

the tow line adaptor comprises a retaining rod which is cooperatively engaged to and maintains the parachute door in attachment to the fuselage when the tow line adaptor is attached thereto;

the detachment of the tow line adaptor from the fuselage facilitating the release of the retaining rod from the parachute door which permits the detachment thereof from the fuselage upon the movement of the latching member to the unlatched position.

18. A method of deploying a glide target from an aircraft having a reeling machine with a tow line, said method comprising the steps of:

(a) attaching the glide target to the tow line;

(b) causing the aircraft to climb to a first altitude and maintain a first air speed;

(c) deploying the glide target from the aircraft by reeling out the tow line of the reeling machine;

(d) causing the aircraft to climb to a second altitude and accelerate to a second air speed; and (e) releasing the glide target from the tow line.

19. The method of claim 18 further comprising the step of:

(f) using global positioning satellites to cause the glide target to glide toward an assigned destination under active control from a launch control site.

20. The method of claim 18 wherein step (c) comprises reeling out the glide target to a distance of approximately fifty meters from the aircraft.

21. A glide target comprising:

a fuselage;

a tow line adaptor releasably attached to the fuselage;

a tow line adaptor release mechanism disposed within the fuselage; and at least one wing lift spoiler attached to the tow line adaptor such that the detachment of the tow line adaptor from the fuselage facilitates the removal of the wing lift spoiler from the fuselage.

* * * * *